US007820561B2

(12) United States Patent
Lube

(10) Patent No.: US 7,820,561 B2
(45) Date of Patent: Oct. 26, 2010

(54) COATED, WATER-VAPOR-PERVIOUS AND FUNGUS-RESISTANT WOVENS, PROCESS OF MAKING, AND ARTICLES MADE THEREFROM

(75) Inventor: Wolfgang Lube, Graz (AT)

(73) Assignee: Sattler AG, Graz (AT)

( * ) Notice: Subject to any disclaimer, the term of this patent is extended or adjusted under 35 U.S.C. 154(b) by 0 days.

(21) Appl. No.: 11/120,217

(22) Filed: May 2, 2005

(65) Prior Publication Data

US 2006/0003650 A1 Jan. 5, 2006

(30) Foreign Application Priority Data

May 3, 2004 (DE) ..... 10 2004 021 520

(51) Int. Cl.
*B32B 33/00* (2006.01)

(52) U.S. Cl. ..... 442/76; 442/79; 442/85; 442/86; 442/123; 442/124

(58) Field of Classification Search ..... 442/59, 442/64, 71, 123, 79–90, 76, 124
See application file for complete search history.

(56) References Cited

U.S. PATENT DOCUMENTS

| | | | | |
|---|---|---|---|---|
| 4,774,131 | A | 9/1988 | Dahmen et al. | 428/286 |
| 5,747,392 | A | 5/1998 | Xiao et al. | 442/82 |
| 2001/0021616 | A1 * | 9/2001 | Bullock et al. | 442/76 |
| 2002/0106955 | A1 * | 8/2002 | Underwood et al. | 442/148 |

FOREIGN PATENT DOCUMENTS

| | | | |
|---|---|---|---|
| DE | 77 32 181 | | 10/1977 |
| DE | 29 48 892 | | 6/1980 |
| DE | 36 33 874 | A1 | 4/1988 |
| DE | 43 01 166 | A1 | 7/1994 |
| DE | 44 22 140 | A1 | 1/1996 |
| GB | 2 039 790 | A | 8/1980 |

OTHER PUBLICATIONS

"Substrat-und Textilbeschichtung", Andreas Giessmann, Oct. 27, 2003, 8 pages.
Search Report in EPO 05 00 9159 dated Aug. 10, 2005.

* cited by examiner

*Primary Examiner*—D. Lawrence Tarazano
*Assistant Examiner*—Matthew D Matzek
(74) *Attorney, Agent, or Firm*—Marshall, Gerstein & Borun LLP

(57) ABSTRACT

Coated, water-vapor-pervious and fungus resistant wovens, their production and also their use as sun and weather protection articles, a precleaned industrial woven fabric being treated at least once with an aqueous impregnant comprising a fungicide and a hydrophobicizer. The fabric thus impregnated and then dried is subsequently coated with an aqueous polyurethane dispersion which likewise contains a fungicide. After drying, the coated fabric is reimpregnated. The wovens are notable for fungus resistance, good water vapor perviousness and good watertightness against a high hydrohead in particular.

15 Claims, No Drawings

COATED, WATER-VAPOR-PERVIOUS AND FUNGUS-RESISTANT WOVENS, PROCESS OF MAKING, AND ARTICLES MADE THEREFROM

BACKGROUND OF THE INVENTION

1. Field of the Invention

The invention relates to coated water-vapor-pervious and fungus-resistant wovens, especially industrial wovens, to a process for producing same and, to their use for the production of sun protection and weather protection articles such as tent materials, boat covers and the like.

2. Related Technology

Water-vapor-pervious textile fabrics are known in particular from the use sectors of functional sports and protective clothing and also various medical sectors. Common processes for producing water-vapor-pervious textiles from the sectors cited above are known in particular under the designations of "Goretex" and "Sympatex," which work according to the principle of producing microporous structures.

Watertight yet moisture-pervious coated textile fabrics and processes for their production are inter alia described in DE 2948892 C2. The processes described therein utilize a polyurethane solution in an organic solvent, producing the microporous layer of polyurethane by coagulation.

Further processes for producing polyurethane-coated textile fabrics which are breathable and water repellent are described for example in DE 3633874 C2. The process described in this patent specification utilizes two aqueous polyurethane dispersions which are applied in succession wet on wet.

However, it has been determined that the water vapor transmission rate is not always satisfactory. In addition, condensates form very frequently in the pores of the coatings. One of the disadvantages of this is that fungi form in these condensates. Inevitably, fungi will also spread in those spaces which are actually to be protected by the coated wovens. Unsightly matt deposits form on the fittings of the interior spaces of ships such as yachts and the like and confer an unsightly appearance on objects in the interior.

It is another frequent occurrence, when thus coated textiles are used as a covering on ships and the coverings develop dents or dips in which water can collect, that the water pressure on the coated textile will increase over time to such an extent that water in liquid form as well as in vapor form is able to pass through the coated woven and get into interior to be protected.

Although there already are a whole series of water-vapor-pervious polyurethane-coated wovens, there is still a need for improved polyurethane-coated wovens and for simple processes for their production and in particular for coated wovens which are particularly useful for producing sun protection and weather protection articles.

SUMMARY OF THE INVENTION

The invention provides a process for producing such coated fabrics, which possess good water vapor perviousness and good water pressure resistance, and in addition possess improved fungus protection properties, are oil, soil, and water-repellent, and which in addition are also weathering-resistant.

Accordingly, the invention provides a process for producing coated water-vapor-pervious and fungus-resistant wovens, wherein a washed woven is impregnated with an aqueous impregnant containing a fungicide and a hydrophobicizer, dried, then coated with an aqueous dispersion of a polyurethane likewise containing a fungicide without further additives such as new color-conferring additives, dried and subsequently reimpregnated with an aqueous hydrophobicizer and dried.

DETAILED DESCRIPTION

The aqueous impregnant preferably comprises 1%-5% and especially 2%-4% by weight of fungicide. The aqueous impregnant advantageously contains 0.2% to 2% and preferably 0.4% to 1% by weight of a hydrophobicizer.

The aqueous dispersion preferably contains hydrophilic polyurethanes.

It is further advantageous when the impregnated and dried woven is at least once coated with an aqueous polyurethane dispersion.

It is further advantageous when the impregnating is effected by pad-mangling or spraying.

The invention further provides coated water-vapor-pervious and fungus-resistant wovens producible by one of the processes indicated above.

The wovens of the invention preferably have a water vapor transmission rate of 800 to 2800 g/m$^2$×24 h at 20-50° C.

Of particular advantage are coated, water-vapor-pervious and fungus-resistant wovens having a water pressure resistance of 800 to 1800 mm hydrohead.

The process of the invention can be carried out as follows.

The initial step is to produce a woven fabric in a conventional manner. The wovens are in particular industrial wovens, which have a higher basis weight and tensile strength than wovens for purely textile purposes. The basis weight of the wovens is advantageously in the range from 150 to 450 g/m$^2$.

The woven is then cleaned, for example by washing it in the loom state by means of a jigger or continuous washing process, to remove in particular residual spin finish and the like.

The woven thus washed and dried is then impregnated with an aqueous impregnant. This impregnant comprises one or more fungicides and also one or more hydrophobicizers. The woven is then impregnated so thoroughly that the fibers and yarns are fully enveloped by impregnant. This is necessary to obtain uniform coating in the subsequent coating process.

After the impregnating step, the woven thus impregnated is dried. The fungicide is generally present in the impregnant in an amount of 20-40 g preferably 30 g per liter of water. The impregnant further comprises a hydrophobicizer in an amount of for example 4-10 g especially 7 g per liter of water.

After the impregnating step, the woven thus impregnated and dried is coated. Aqueous dispersions of hydrophilic polyurethanes are used for coating. The aqueous dispersion shall comprise sufficient polyurethane to ensure that an adequate amount of polyurethane is applied to the woven. The amount is advantageously determined such that the fabric comprises between 30 and 50 g of coating add-on per square meter of area, these indications of amount relating to polyurethane solids.

The aqueous coating further contains a fungicide, preferably the same fungicide, or else if appropriate a fungicide which is similar or of the same type, as used in the impregnation. The coating may further contain customary additives, such as color pigments for example.

Once a sufficient and uniform coating has been applied to the woven, the woven is dried and is then subjected to a further impregnation with an aqueous system containing a hydrophobicizer, preferably 3 to 5 g per 100 g of aqueous composition. This reimpregnation provides an improvement in oil, water and soil repellency.

Wovens thus coated possess in particular good water vapor perviousness, a high water pressure resistance, good oil, soil and water repellency and also excellent fungus resistance. These performance characteristics last throughout the entire use life, so that the protected interior likewise remains protected against moisture and fungal colonization.

The wovens thus coated are very useful according to the invention for solar protection and weather protection articles. To be identified in particular here are tent materials, tent roofs, beer tent fabrics, boat covers, boat winter storage covering, boat summer covering, sprayhoods in the boat sector, bow protection panes on boats, including in particular those sheetlike structures which are intended to protect on-boat rooms and spaces, for example cabins, against moisture and fungus formation.

The yarns for the wovens may utilize polyester, in particular polyethylene terephthalate filaments and fibers, for example filament yarns, continuous filament fibers or staple fiber yarns, fibers composed of acrylics, cotton and also blends of synthetic sand natural fibers or manufactured fibers such as cellulosic fibers.

Useful further ingredients to be added at impregnation or coating include customary additives, for example color pigments.

The example which follows illustrates the invention:

Example

The base fabric to be finished in this operative example is a woven acrylic fiber fabric having a basis weight of about 300 g/m$^2$, this fabric having been produced from spun-dyed staple fiber yarns.

The substrate is washed in a first step of the process by means of a jigger or continuous washing process to remove residual substances such as spin finishes from the loom state fabric.

The next step consists in a preimpregnating operation which insures, on the one hand, that the coating film can be uniformly applied in the subsequent coating process and, on the other, the fungicide is uniformly distributed in the fabric.

In this preimpregnating operation, the fungicide is present in an amount of 20 to 40 g-preferably 30 g-per liter of water and a hydrophobicizer is present in an amount of 4 to 10 g—for example 7 g—per liter of water.

The effect of the hydrophobicizer is that the coating is applied as a film on the surface of the fabric in the next step.

The subsequent coating process provides for uniform application of a water-vapor-pervious polyurethane—namely a hydrophilic aliphatic polyurethane—(or else a mixture of this polyurethane with another polyurethane) in the form of an aqueous dispersion in a one-pass process, the amount applied to the fabric being between 30 and 50 g/m$^2$-preferably 40 g/m$^2$.

This amount is to be understood as meaning that amount of solids which is present in dissolved form in an aqueous solution of 100 g total weight which is used per m$^2$ of fabric to be coated.

The coating, i.e. the aqueous dispersion, further comprises the fungicide of the same type in a concentration of 3% to 5%-4% for this example—i.e. 4 g in 100 g of aqueous dispersion.

Finally, the fabric thus coated is subjected to a reimpregnation through a customary pad-mangling process in which the hydrophobicizer is again present in an amount of 4 g of 100 g of aqueous solution, whereby adequate oil, water and soil repellency is additionally achieved on the textile end product.

The invention claimed is:

1. Coated, water-vapor-pervious, and fungus-resistant wovens having a water vapor transmission rate of 800 g/m$^2$ to 2800 g/m$^2$×24 h at a temperature in the range of 20° C. to 30° C. and a water pressure resistance of 800 mm to 1800 mm hydrohead produced by a process comprising:

(a) impregnating a precleaned woven comprising fibers and yarns and having a basis weight of 150 g/m$^2$ to 450 g/m$^2$ with an aqueous impregnant comprising 1 wt. % to 5 wt. % of a fungicide and 0.2 wt. % to 2 wt. % of a hydrophobicizer in such a way that the fibers and yarns of the woven are fully enveloped by the impregnant, (b) drying the impregnated woven of (a), (c) subsequently coating the dried woven of (b) with an aqueous dispersion of a hydrophilic polyurethane, said dispersion comprising 3 wt. % to 5 wt. % of a fungicide, (d) drying the coated woven of (c), and (e) subsequently reimpregnating the dried woven of (d) with an aqueous hydrophobicizer, and, (f) drying the impregnated woven of (e), wherein the hydrophilic polyurethane is applied in (c) in an amount such that the dried woven of (f) contains a coating in an amount of between 30 g/m$^2$ and 50 g/m$^2$ dry substance polyurethane.

2. Wovens of claim 1, wherein the process comprises repeating (a) and (b) at least once.

3. Wovens of claim 1, wherein the process comprises repeating (c) at least once.

4. Wovens of claim 1, wherein the process comprises effecting the impregnating of (a) by pad-mangling or by spraying.

5. Wovens of claim 1, wherein said aqueous dispersion of (c) is free of additives.

6. Wovens of claim 1, wherein the aqueous impregnant of (a) comprises 2% to 4% by weight of fungicide.

7. Wovens of claim 1, wherein the aqueous impregnant of (a) comprises 0.4 wt. % to 1 wt. % of the hydrophobicizer.

8. Wovens of claim 1, wherein the process comprises effecting the coating of (c) by knife coating.

9. Wovens of claim 8, wherein said knife coating is selected from the group consisting of air knife coating, knife over roll coating, and Magno roller knife coating.

10. Wovens of claim 1, wherein said aqueous dispersion of (c) comprises an additive in addition to polyurethane.

11. Wovens of claim 10, wherein said additive is a color pigment.

12. Sun and weather protection articles comprising a coated, water-vapor-pervious, and fungus resistant woven of claim 1.

13. Article of claim 12 comprising a tent.

14. Article of claim 12 comprising a boat cover or a sprayhood for a boat.

15. Article of claim 14, selected from the group consisting of boat winter storage covers and boat summer covers.

* * * * *